US006915738B2

(12) United States Patent
Mori

(10) Patent No.: US 6,915,738 B2
(45) Date of Patent: Jul. 12, 2005

(54) MASTER MAKING DEVICE AND STENCIL PRINTER USING THE SAME

(75) Inventor: Tomiya Mori, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 10/763,240

(22) Filed: Jan. 26, 2004

(65) Prior Publication Data

US 2004/0216626 A1 Nov. 4, 2004

(30) Foreign Application Priority Data

Mar. 3, 2003 (JP) ..... 2003-055855

(51) Int. Cl.[7] ..... B41C 1/14
(52) U.S. Cl. ..... 101/128.4; 101/129
(58) Field of Search ..... 101/128.4, 114, 101/116, 118, 119, 120, 124, 129

(56) References Cited

U.S. PATENT DOCUMENTS 5,640,904 A * 6/1997 Sato et al. ..... 101/128.4
6,050,184 A * 4/2000 Kidoura et al. ..... 101/128.4
6,095,040 A * 8/2000 Ashikagaya et al. ..... 101/120
6,371,016 B2 * 4/2002 Takasawa et al. ..... 101/129
6,626,098 B1 * 9/2003 Kanamori ..... 101/128.4
6,718,872 B2 * 4/2004 Kanno ..... 101/118

FOREIGN PATENT DOCUMENTS

| | | |
|---|---|---|
| JP | 6-135112 | 5/1994 |
| JP | 2000-280596 | 10/2000 |
| JP | 2001-122462 | 5/2001 |
| JP | 2001-297891 | 10/2001 |
| JP | 2002-103565 | 4/2002 |

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

A stencil making device of the present invention includes a front tension roller pair located downstream of the nip of a thermal head and a platen roller for applying tension to a stencil. The front tension roller pair is made up of an upper roller formed of rubber and a lower roller formed of metal. The lower roller is formed with a plurality of groove portions spaced from each other in the axial direction and each having a small diameter not contacting the stencil. The groove portions therefore reduce the area of contact with the stencil for thereby reducing the influence of static electricity on the stencil.

16 Claims, 6 Drawing Sheets

Fig. 5

| GROOVE WIDTH W | CONVEYANCE QUALITY | NOTE |
|---|---|---|
| 40 mm | △ | DEFECTIVE CONVEYANCE DUE TO STATIC ELECTRICITY |
| 30 mm | ○ | SMOOTH CONVEYANCE |
| 20 mm | ○ | SMOOTH CONVEYANCE |
| 10 mm | ○ | SMOOTH CONVEYANCE |
| 5 mm | ○ | SMOOTH CONVEYANCE |
| 0 mm | × | DEFECTIVE CONVEYANCE DUE TO STATIC ELECTRICITY |

*Fig. 6*

| GROOVE DEPTH t | STENCIL A | STENCIL B | NOTE |
|---|---|---|---|
| 0.0 mm | × | × | DEFECTIVE CONVEYANCE DUE TO STATIC ELECTRICITY |
| 0.05 mm | ○ | × | STATIC ELECTRICITY ONLY ON MASTER B |
| 0.1 mm | ○ | ○ | SMOOTH CONVEYANCE, NO CREASING |
| 0.4 mm | ○ | ○ | SMOOTH CONVEYANCE, NO CREASING |
| 0.5 mm | × | ○ | CREASING OF MASTER A |
| 1.0 mm | × | × | CREASING OF MASTERS A AND B |

MASTER MAKING DEVICE AND STENCIL PRINTER USING THE SAME

BACKGROUND OF THE INVENTION

1. Field of the Invention

The present invention relates to a master making device for making a master in accordance with image data and a stencil printer using the same.

2. Description of the Background Art

It is a common practice with a master making device for a stencil printer to cause a platen roller in rotation to convey a stencil paid out from a roll while nipping it between the platen roller and a thermal head and cause the thermal head to perforate, or cut, the stencil. A roller pair, positioned downstream of the platen roller in the direction of stencil conveyance, further conveys the perforated stencil toward, e.g., a guide plate. The guide plate is configured to guide the perforated stencil to a print drum. The problem with this type of master making device is that when the stencil leaves the platen roller or the roller pair, i.e., when the stencil is peeled off the roller surface, peel discharge occurs and causes the stencil to electrostatically adhere to the guide or similar member, resulting in defective conveyance.

In light of the above, it has been customary to locate a discharge brush around the outlet of the nip of, e.g., the roller pair and bring the stencil into contact with the discharge brush for thereby discharging the stencil. However, the discharge brush cannot efficiently function when the charge potential of the stencil is low.

Further, a soft stencil is apt to easily adhere to the guide plate or similar member even when the amount of static electricity deposited thereon is small, also resulting in defective conveyance. Although a number of discharge brushes may be arranged for enhancing the discharging function, they undesirably increase the cost and complicate the construction of the master making device.

Technologies relating to the present invention are disclosed in, e.g., Japanese Patent Laid-Open Publication Nos. 2000-280596, 2001-122462, 2001-297891, 2002-103565 and 6-135112.

SUMMARY OF THE INVENTION

It is an object of the present invention to provide a low cost, simple master making device capable of surely conveying even a soft stencil by reducing the influence of static electricity, and a stencil printer using the same.

A master making device of the present invention includes a master making section for making a master in accordance with image data, and a plurality rotary conveying members different in position from each other and configured to convey the stencil in pressing contact therewith. Among the plurality of rotary conveying members, one of rotary conveying members, which are paired with each other, expected only to convey the master reduces charging of the stencil.

A stencil printer using the above master making device is also disclosed.

BRIEF DESCRIPTION OF THE DRAWINGS

The above and other objects, features and advantages of the present invention will become more apparent from the following detailed description taken with the accompanying drawings in which:

FIG. 5 is a table showing the results of experiments conducted to determine a relation between the width of a groove portion formed in one of front tension rollers and conveyance; and FIG. 6 is a table showing the results of experiments conducted to determine a relation between the depth of the groove portion and the thickness of a stencil.

DESCRIPTION OF THE PREFERRED EMBODIMENT

Figure 1:
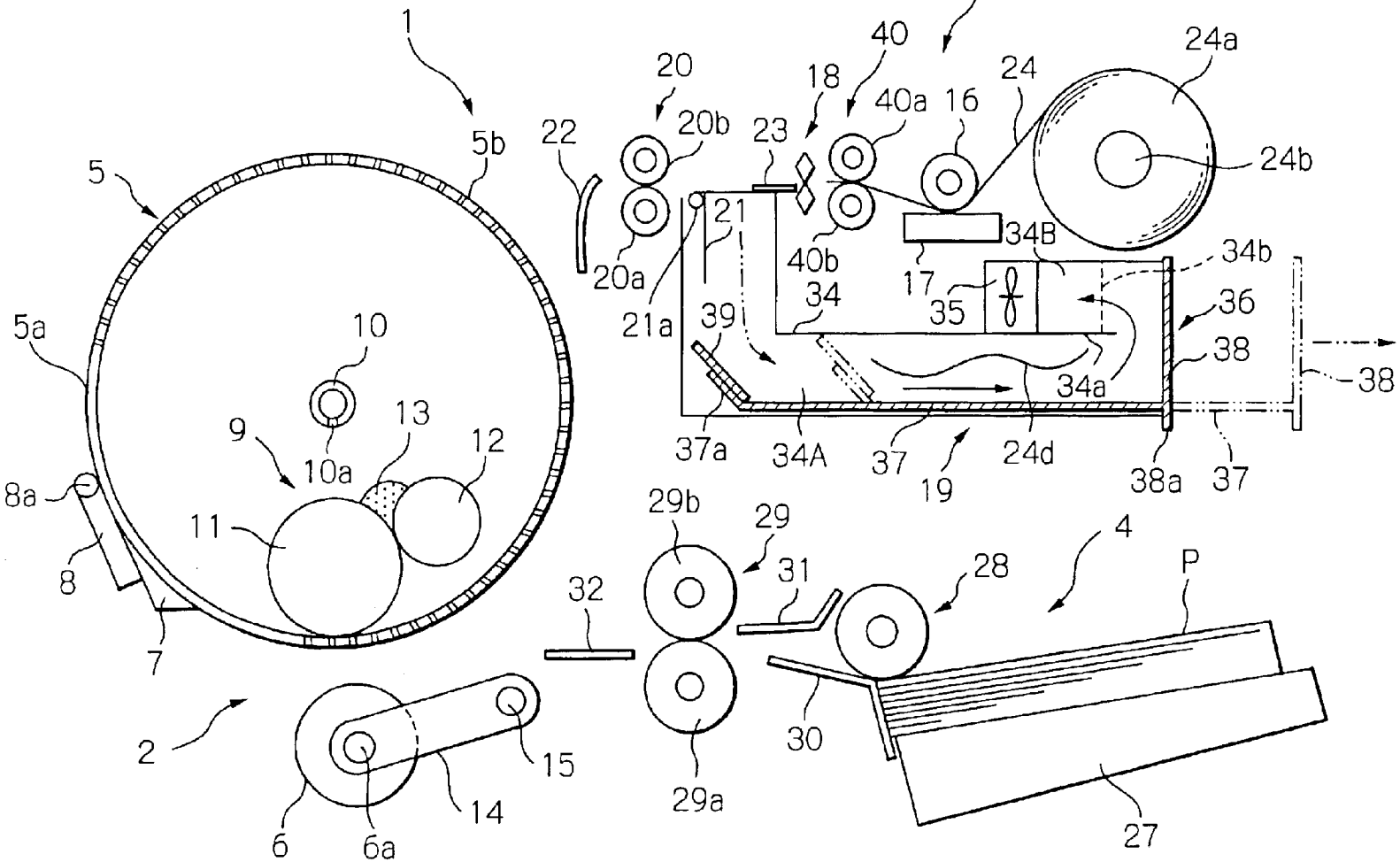
FIG. 1 is a front view showing a stencil printer embodying the present invention.

Referring to FIG. 1 of the drawings, a stencil printer embodying the present invention is shown and generally designated by the reference numeral 1. As shown, the stencil printer 1 is generally made up of a printing section 2, a master making device 3, and a sheet feeding device 4.

The printing section 2 is located at substantially the center of the printer body, not shown, and includes a print drum 5 and a press roller 6. The print drum 5 is caused to rotate clockwise, as viewed in FIG. 1, by drive means not shown. The press roller 6 is positioned below the ink drum 5 and selectively movable into or out of contact with the print drum 5 and presses a sheet P fed from the sheet feeding device 4 against the print drum 5 when contacting the print drum 5. The print drum 5 includes a porous support plate 5*a* affixed to the circumferential edges of a pair of flanges, not shown, at opposite ends and a laminate of mesh screens wrapped around the support plate 5*a*. Part of the porous support plate 5*a* is formed with a plurality of apertures 5*b*.

A flat stage 7 is positioned in the portion of the porous support plate 5*a* where the apertures 5*b* are absent, and extends in parallel to the axis of the print drum 5. A clamper 8 is mounted on the stage 7 and openably supported by a shaft 8*a*. Opening/closing means, not shown, causes the clamper 8 to open and close when the print drum 5 in rotation reaches a preselected position.

Ink feeding means 9 is arranged inside the print drum 5 and includes an ink feed pipe 10, an ink roller 11, and a doctor roller 12. The ink feed pipe 10 extends between the pair of flanges mentioned earlier and supports the flanges via bearings, not shown, such that the flanges are freely rotatable thereon. An ink pump and an ink pack are connected to the ink feed pipe 10 such that ink is fed from the ink pack to the inside of the print drum 5 via apertures 10*a* formed in the pipe 10 by the ink pump, although not shown specifically.

The ink roller 11 is rotatably mounted on a pair of side walls, not shown, affixed to the ink feed pipe 10 between the pair of flanges. Drive means, not shown, causes the ink roller 11 to rotate in synchronism with the print drum 5. The ink roller 11 is spaced from the inner periphery of the print drum 5 by a small gap.

A doctor roller 12 is positioned in the vicinity of the ink roller 11 and rotatably supported by the side walls like the ink roller 11. Drive means, not shown, causes the doctor roller 12 to rotate in synchronism with, but in opposite direction to, the ink roller 11. The doctor roller 12 and ink roller 11 are spaced from each other by a small gap, forming a generally wedge-shaped space therebetween. The ink fed via the apertures 10*a* drops into the above space, which will be referred to as an ink well 13 hereinafter. The ink in the ink well 13 deposits on the ink roller 11 in a thin layer when passing through the position where the ink roller 11 and doctor roller 12 adjoin each other. Subsequently, when the press roller 6 presses the print drum 5, the outer periphery of the ink roller 11 and the inner periphery of the print drum 5 contact each other with the result that the ink is transferred from the ink roller 11 to the print drum 5.

The press roller 6 has substantially the same axial length as the print drum 5 and made up of a core 6*a* and rubber or similar elastic material wrapped around the core 6*a*. The core 6*a* is rotatably supported by one end of a pair of flat, press roller arms 14 (only one is visible) at opposite ends. The other ends of the press roller arms 14 are affixed to a press roller shaft 15, which is rotatably supported by the printer body. Press roller moving means, not shown, causes the press roller arms 14 to angularly move about the press roller shaft 15 integrally with each other. The press roller arms 14, in turn, selectively move the press roller 6 to a released position where the press roller 6 is spaced from the print drum 5, see FIG. 1, or a pressing position where the former presses the latter.

The master making device 3 is arranged above the printing section 2 at the right-hand side. The master making device 3 includes master holding members, not shown, a platen roller or rotary conveying member 16, a thermal head or perforating means 17, a front tension roller pair or rotary conveying member pair 40, cutting means 18, a master guide 23, master stocking means 19, a roller pair 20 for conveyance, a movable master guide plate 21, and a master feed guide 22.

In the illustrative embodiment, a stencil 24 is implemented as a roll 24*a* including a core 24*b*. The master holding members, respectively mounted on a pair of side walls included in the master making device 3, support the core 24*b* of the stencil roll 24*a* such that the core 24*b* is rotatable and removable, as needed.

In the illustrative embodiment, the stencil 24 has a three-layer structure made up of a thermoplastic resin film, a porous resin layer formed on one major surface of the thermoplastic resin film, and a porous fiber layer formed on the surface of the porous resin layer, as taught in, e.g., Japanese Patent Laid-Open Publication No. 10-147075. Although a stencil is soft and low in strength, it allows ink to be uniformly transferred for thereby enhancing image quality and reduces ink consumption.

The platen roller 16, positioned at the left-hand side of the stencil roller 24*a*, has a length substantially identical with the width of the stencil 24 and is rotatably supported by the side walls of the printer body. The platen roller 16 is caused to rotate clockwise, as viewed in FIG. 1, by a stepping motor, not shown, mounted on the printer body.

The thermal head 17, positioned below the platen roller 16, has a width greater than the length of the platen roller 16 and is provided with a plurality of heating devices on the top thereof. Biasing means, not shown, constantly biases the thermal head 17 in such a manner as to press the thermal head 17 against he platen roller 16. A thermal head driver, not shown, controls the individual heating devices in accordance with an operation signal, which is output from an image scanner, not shown, in accordance with image data. The image scanner is positioned in the upper portion of the printer body.

The front tension roller pair 40 is positioned downstream of the platen roller 16 in the direction stencil conveyance and made up of an upper and a lower front tension roller 40*a* and 40*b*, respectively. The front tension roller pair 40 applies tension to part of the stencil 24 downstream of the platen roller 16. The material and configuration of the front tension roller pair 40 will be described in detail later.

The cutting means 18, positioned downstream of the front tension roller pair 40, cuts the perforated portion of the stencil or master, also labeled 24, at a preselected position away from the other portion of the stencil 24. The cutting means 18 is mounted on the printer body and includes an upper blade and a lower blade although it may be replaced with guillotine type of cutting means or rotary edge type of cutting means. The master guide plate 23 is positioned downstream of the cutting means 18.

The master stocking means 19 is located downstream of the master guide plate 23. The stencil 24 perforated, but not cut away, is introduced into the master stocking means 19 via an opening formed in the top of the master stocking means 19 and temporarily stocked therein, as will be described more specifically later. The master stocking means 19 is made up of a body 34, a suction fan 35 disposed in the upper deep portion of the body 34, and a master removal tray 36 movable into and out of the body 34 along the master stocking path.

The suction fan 35 generates vacuum in the hermetically closed space of the master stocking means 19 to thereby produce an air stream indicated by an arrow in FIG. 1. The air stream entrains the perforated stencil 24 deep into the master stocking means 19, so that the stencil 24 is stored in the master stocking means, see FIG. 4. The master stocking means 19 will be described more specifically later. It is to be noted that opposite side walls of the body 34 are simply represented by single lines although they have thickness in practice. This is also true in the other figures.

The roller pair 20, positioned at the left-hand side (downstream) of the master stocking means 19, is made up of a drive roller 20*a* and a driven roller 20*b* rotatably mounted to the side walls. The drive roller 20*a* driven by drive means, not shown, and driven roller 20*b* pressed against the drive roller 20*a* nip and convey the perforated stencil 24. A one-way clutch, not shown, is included in the drive roller 20*a*.

The movable master guide plate 21 is mounted on the top of the master stocking means formed with the opening mentioned earlier. The movable master guide plate 21 has its base end supported by a shaft 21*a*, which is rotatably supported by the side walls. The movable master guide plate 21, driven by a stepping motor not shown, selectively, angularly moves to a conveying position indicated by a dash-and-dots line or a retracted position indicated by a solid line. The movable master guide plate 21 guides, in the conveying position, the perforated stencil 24 toward the roller pair 20 or does not interfere, in the retracted position, with the stencil 24 being introduced into the master stocking means 19.

The master feed guide plate 22 is positioned at the left-hand side of the roller pair 20 in order to guide the perforated stencil 24 toward the printing section 2. The master feed guide plate 22 is affixed to the side walls.

The sheet feeding device 4, positioned at the right-hand side of the printing section 2 below the master making device 3, includes a tray 27 loaded with a stack of sheets P, a pickup roller 26, and a registration roller pair 29. The tray 27 is supported by the printer body and movable in the up-and-down direction by being driven by tray moving means The pickup roller 28 is positioned above the tray 27 at a position corresponding to the leading edge of the sheet stack P in the direction of sheet conveyance. The pickup roller 28, provided with a high frictional resistance member on the circumference thereof, is rotatably supported by the side walls, not shown, of the sheet feeding device 4 and constantly pressed downward, as viewed in FIG. 1, by biasing means not shown. In this configuration, when the tray 27 is raised by the tray moving means to a sheet feed position, the pickup roller 28 is pressed against the top sheet P of the tray 27 by a preselected pressure and then rotated clockwise, as viewed in FIG. 1, by sheet feed motor not shown.

A sheet separating member 30 is positioned below the pickup roller 28 at a position downstream of the leading edge of the sheet stack P in the direction of sheet conveyance. The sheet separating member 30 is implemented by a high frictional resistance member and pressed against the circumference of the pickup roller 28 by a preselected pressure, which is exerted by biasing means not shown.

The registration roller pair 29 is positioned downstream of the sheet separating member 30 in the direction of sheet conveyance and made up of a drive roller 29*a* and a driven roller 29*b*, which are rotatably supported by the side walls of the sheet feeding device 4. The drive roller 29*a* driven by registration drive means, not shown, and driven roller 29*b* pressed against the drive roller 29*a* once stop the sheet P paid out from the tray 27 by the pickup roller 28 and then start feeding it to a position between the print drum 5 and the press roller 6.

A sheet guide 31 is positioned between the pickup roller 28 and the registration roller pair 29 while a sheet guide 32 is positioned downstream of the registration roller 29 in the direction of sheet conveyance. The sheet guides 31 and 32 are affixed to the side walls of the sheet feeding device 4.

Image data representative of a document image, which is read by the image scanner mentioned earlier, are written to an image memory, not shown, read out later, and then formed in the stencil 24 by the thermal head 17.

A conventional master discharging device, not shown, is positioned above the printing section 2 at the left-hand side and configured to peel off a used master wrapped around the print drum 5. The master discharging device includes a master discharging member movable into and out of contact with the print drum 5, a waste master box for storing the used master, and a compressor for compressing the used master in the waste mater box.

A conventional sheet discharging section, not shown, is arranged below the printing section 2 at the left-hand side and configured to drive the sheet or print P coming out of the printing section 2 to the outside of the printer body. The sheet discharging section includes a peeler for peeling the sheet P off the print drum 5, a conveyor for conveying the sheet P, and a print tray for stacking the sheet P.

In operation, the operator of the stencil printer 1 sets a desired document on the image scanner and then presses a perforation start key positioned on an operation panel not shown. In response, the stencil printer 1 performs an image reading operation and a master discharging operation in parallel. After a used master has been collected, the print drum 5 is rotated to a position where the clamper 8 faces substantially sideways at the right-hand side of the print drum 5, and then stopped at the above position. Subsequently, the opening/closing means causes the clamper 8 to open. In this condition, the stencil printer is held in a stand-by position shown in FIG. 4.

As for the master making operation effected in parallel with the image reading operation, the stepping motor drives the platen roller 16 while the drive means drives the front tension roller pair 40 and roller pair 20, so that the stencil 24 is paid out from the roll 24*a*. The stencil 24 is then perforated by the thermal head 17 in accordance with the image data while being conveyed by the platen roller 16.

As soon as the roller pair 20 nips the leading edge of the stencil 24, the drive means assigned to the roller pair 20 is deenergized and stops driving the roller pair 20. At the same time, the stepping motor assigned to the movable master guide plate 21 is energized to turn the guide plate 21 clockwise to the retracted position shown in FIG. 1. Further, the suction fan 35 is energized at the same time as the operation of the stepping motor.

Figure 4:
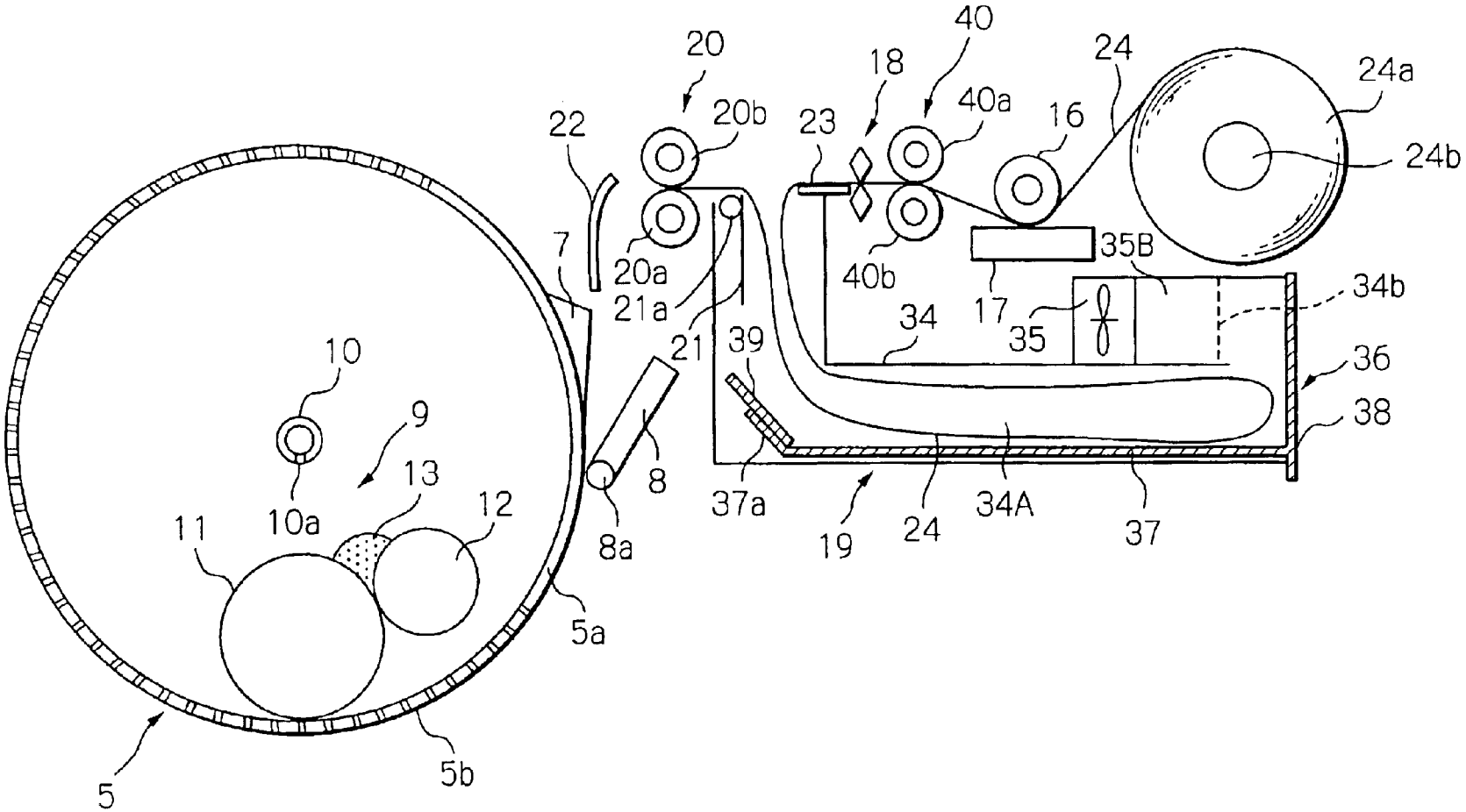
FIG. 4 is a front view showing perforated part of the stencil sucked into master stocking means included in the illustrative embodiment.

The thermal head 17, platen roller 16 and front tension roller pair 40 continuously operate even after the stop of rotation of the roller pair 20, so that the stencil 24 being perforated is sucked into the master stocking means 19 by the suction fan 35, as shown in FIG. 4. When the print drum 5 is brought to the stand-by position, FIG. 4, and when the perforated stencil 24 is stored in the master stocking means 19 by more than a preselected amount, the roller pair 20 is driven by the associated drive means to thereby convey the stencil 24 toward the stage 7 and clamper 8, which is held open.

When the leading edge of the stencil 24 is determined to have reached a preselected position between the stage 7 and the clamper 8, the opening/closing means closes the clamper 8 for thereby retaining the leading edge of the stencil 24 on the print drum 5. At the same time, the drive means assigned to the roller pair 20 is deenergized to stop rotating the roller pair 20. After the closing of the clamper 8, the print drum 5 is intermittently rotated clockwise, as viewed in FIG. 4, at low speed with the result that the stencil 4 is wrapped around the print drum 5.

Assume that the stencil 24 is fully perforated by a length corresponding to a single master, as determined in terms of the number of steps of the stepping motor assigned to the platen roller 16. Then, the above stepping motor is deenergized while the cutting means 18 is operated to cut the stencil 24 for thereby producing a single master 24. The master 24 thus cut away is paid out from the master making device 3 by the rotation of the print drum 5 and sequentially wrapped around the print drum 5.

After the entire master 24 has been wrapped around the print drum 5, the stepping motor assigned to the movable master guide plate 21 is energized to turn the guide plate 21 counterclockwise about the shaft 21*a* until the guide plate 21 reaches the conveying position, which is indicated by the dash-and-dots line in FIG. 1. Subsequently, the pickup roller 28 is rotated to pay out the top sheet P from the tray 27 while, at the same time, the print drum 5 is rotated clockwise at low speed.

The sheet P thus paid out while being separated from the underlying sheets P by the sheet separating member 30 has its leading edge nipped by the registration roller pair 29 and temporarily stopped thereby. This is successful to correct the skew of the sheet P. The registration roller pair 29 starts conveying the sheet P toward the printing section 2 at the time when the leading edge of the perforated area of the master 24, which is present on the print drum 5, arrives at the press roller 6.

The press roller moving means brings the press roller 5 into contact with the print drum 5 substantially at the same time as the above operation of the registration roller pair 29. In this condition, the press roller 6 presses the porous support plate 5*a*, mesh screens, master 24 and sheet P by a preselected pressure. As a result, the ink deposited on the inner periphery of the print drum 5 by the ink roller 11 is sequentially transferred to the sheet P via the apertures 5*b*, the openings of the mesh screens and the porous resin film, porous fiber layer and perforations of the thermoplastic resin film of the stencil 24, causing the stencil 24 to fully adhere to the print drum 5. Subsequently, the sheet P is peeled off the print drum 5 by the peeler and then driven out to the print tray by the conveyor.

After the procedure described so far, the operator inputs a printing position, a printing speed and other desired conditions on keys also arranged on the operation panel and then presses a trial print key not shown. In response, the print drum 5 is caused to rotate at a peripheral speed matching with the input printing speed while the sheet feeding device 4 is caused to feed a single paper P. As a result, a trial print is produced in exactly the same manner as at the time of adhesion of the stencil 24 to the print drum 5. If the trial print is acceptable, the operator inputs a desired number of prints on the operation panel and presses a print start key. In response, the sheets P are continuously fed from the sheet feeding device 4 and subject to printing in the same manner as the trial print.

After the desired number of prints have been fully output, the entire stencil printer 1 stops operating and again waits in the stand-by condition.

The configuration of the master stocking means 19 and master removing function available therewith will be described hereinafter. As shown in FIG. 1, the box-like body 34 of the master stocking means 19 has a main space 34A for storing the perforated stencil 24 introduced via the top opening and a subspace 34B turned upward from the main space 34A by a partition 34*a*. The suction fan 35 is positioned in the deepest position of the subspace 34B in the direction of suction. A wire net or similar filter 34*b* is positioned at the right-hand side of the suction fan 35 so as to pass the air stream therethrough while intercepting cut wastes produced from the stencil 24.

The master removal tray 36 is made up of a flat body 37 slidable at the inside of the bottom of the main space 34A, i.e., the bottom of the master stocking means 19 and a handle member 38 affixed to the outermost end of the body 37. The body 37 and handle member 38 are formed of synthetic resin integrally with each other. The handle member 38 additionally serves to close the rear ends of the main and subspaces 34A and 34B remote from the print drum 5.

A bent portion 37*a* extends obliquely upward from the front end of the body 37 close to the print drum 5. A scraper 39 is affixed to the bent portion 37*a* in order to scrape the underside of the partition 34*a*, which forms part of the inner surfaces of the master stocking means 19. The scraper 39 has substantially the same width as the partition 34*a* in the widthwise direction of the stencil 24, which is perpendicular to the direction of conveyance.

The handle member 38 is implemented as a flat plate slightly larger in area than the total area of the rear openings of the main and subspaces 34A and 34B. The lower end of the handle member 38 is extended downward to form a grip portion 38*a*.

If the stencil 24 to be set is folded or curled, then the leading edge portion of the stencil 24 is sometimes cut away in order to accurately position the leading edge of the stencil 24. The resulting waste 24*d* is sucked into the main space 34A and then removed with the body 37 being pulled out, as indicated by a dash-and-dots line in FIG. 1.

Figure 2:
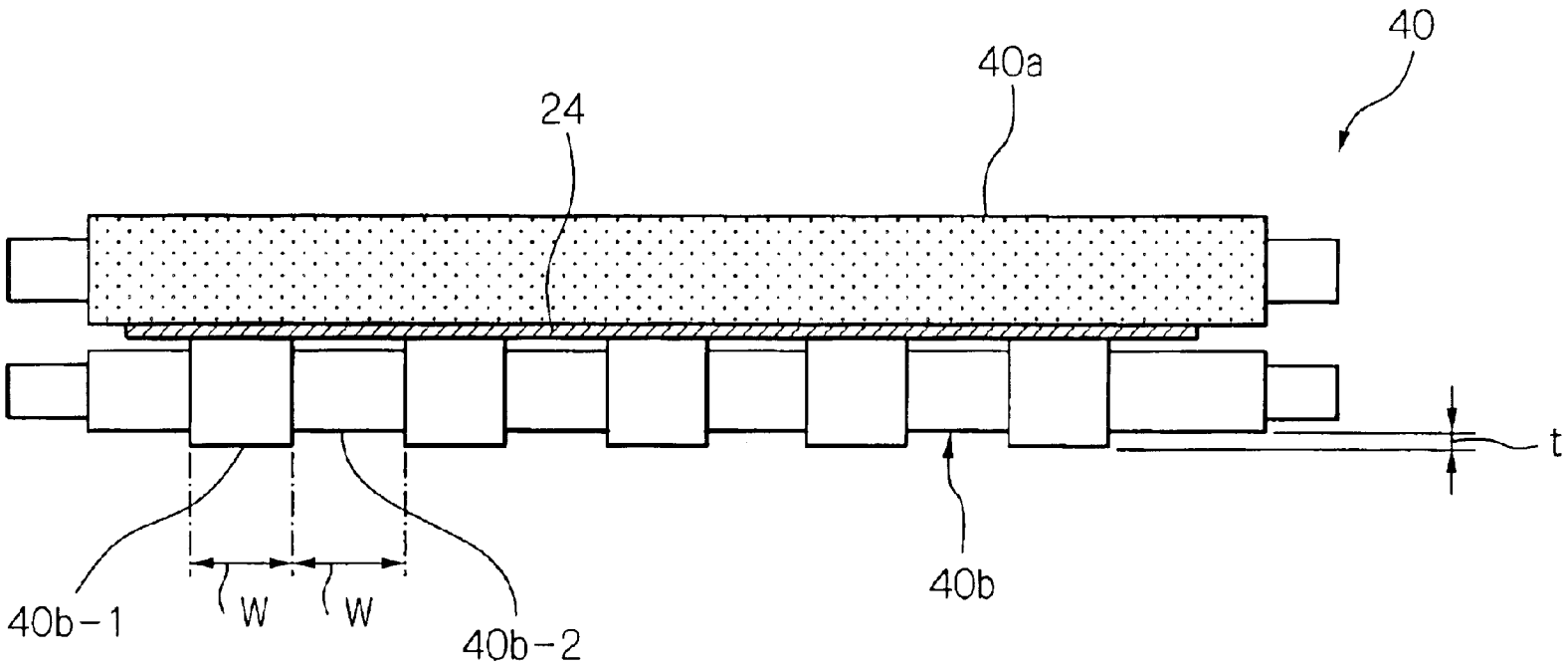
FIG. 2 is a side elevation showing a front tension roller pair included in the illustrative embodiment and nipping a stencil.

Reference will be made to FIG. 2 for describing the material and configuration of the front tension roller pair 40. As shown, the upper front tension roller 40*a* is formed of rubber while the lower front tension roller or driven roller 40*b* is formed of metal and therefore provided with a smooth surface. The lower front tension roller 40*b* has annular contact portions 40*b*-1 and annular groove portions 40*b*-2 smaller in diameter than the contact portions 40*b*-1 and alternating with the contact portions 40*b*-1 in the axial direction. The contact portions 40*b*-1 are expected to contact the stencil 24.

Although the stencil 24 contacts the lower front tension roller 40*b* before reaching the nip of the front tension roller pair 40, it smoothly moves to the above nip without having its position effected by friction because the roller 40*b* has a smooth surface. This prevents the stencil 24 from reaching the nip in an unexpected position and being creased or otherwise deformed.

In the illustrative embodiment, each contact portion 40*b*-1 and each groove portion 40*b*-2 are provided with substantially the same width of W, as measured in the axial direction. The groove portions 40*b*-2 successfully reduce the area over which the stencil 24 is nipped and therefore charged by the front tension roller pair 40, thereby reducing the amount of static electricity to deposit on the stencil 24.

However, reducing the area of the stencil 24 to be nipped degrades conveyance at the same time. In light of this, a series of experiments were conducted to determine a relation between the width W of each groove portion 40*b*-2 and conveyance for the purpose of selecting the optimum condition of the lower front tension roller 40*b*. FIG. 5 shows the results of experiments.

As FIG. 5 indicates, when the width W of the groove portion 40*b*-2 was 40 mm or 0 mm (conventional product), the charging of the stencil 24 was not improved and caused the stencil 24 to electrostatically adhere to, e.g., the guide plate 23 on the path downstream of the front tension roller pair 40, resulting in defective conveyance. This was particularly true with a soft stencil provided with the three-layer structure stated previously. Further, when the width W was as large as 40 mm, the stencil 24 presumably contacted even the groove portions 24*b*-2, i.e., so that the overall contact area was not reduced.

Considering the experimental results of FIG. 5, the illustrative embodiment provides each groove 40*b*-2 with a width W of 5 mm or above, but 30 mm or below. While the illustrative embodiment provides the contact portions 40*b*-1 and groove portions 40*b*-2 with substantially the same width, any other suitable pattern may be used so long as it satisfies the above condition. Also, the annular grooves may be replace with axial grooves and circular grooves arranged in a zigzag pattern in the circumferential direction for reducing the contact area.

The depth t of each groove portion 40*b*-2 is considered to be another factor that effects the charging and conveyance of the stencil 24. Experiments were conducted to determine a relation between the depth t of the groove portion 40*b*-2 and the thickness of the stencil 24 for the purpose of selecting the optimum configuration of the lower front tension roller 40*b*. FIG. 6 shows the results of experiments. In FIG. 6, a stencil A is a 0.04 mm thick stencil having the three-layer structure while a stencil B is a conventional 0.05 mm thick stencil lacking the porous resin layer.

Considering the experimental results of FIG. 6, the illustrative embodiment provides each groove portion 40*b*-2 with a depth t of (1×stencil thickness) or above, but (10×stencil thickness) or below. Any stencil with thickness lying in such a range is free from defective conveyance ascribable to an electrostatic force as well as creases during conveyance.

Now, when the lower front tension roller 40*b* is formed with the groove portions or non-contact portions 40*b*-2, the stencil 24 is nipped by the roller 40*b* at some positions, but not nipped at the other positions at all, resulting in a non-uniform nip pressure distribution. Such a non-uniform nip pressure distribution makes tension acting between the platen roller 16 and the front tension roller pair 40 non-uniform. This effects nip pressure acting between the platen roller 16 and the thermal head 17 and thereby causes the thermal head 17 to perforate the unexpected portion of the stencil 24. This problem becomes more serious as the distance between the platen roller 16 and the front tension roller pair 40 increases.

To solve the problem stated above, the illustrative embodiment locates the nip center of the front tension roller pair 40 and the nip center of the platen roller 16 and thermal head 17 at a distance L smaller than the conventional distance. The distance L is suitably selected by experiments within a range in which the influence of the nip pressure of the master 24 derived from the front tension roller pair 40 does not extend to the nip pressure of the platen roller 16 and thermal head 17.

Figure 3:
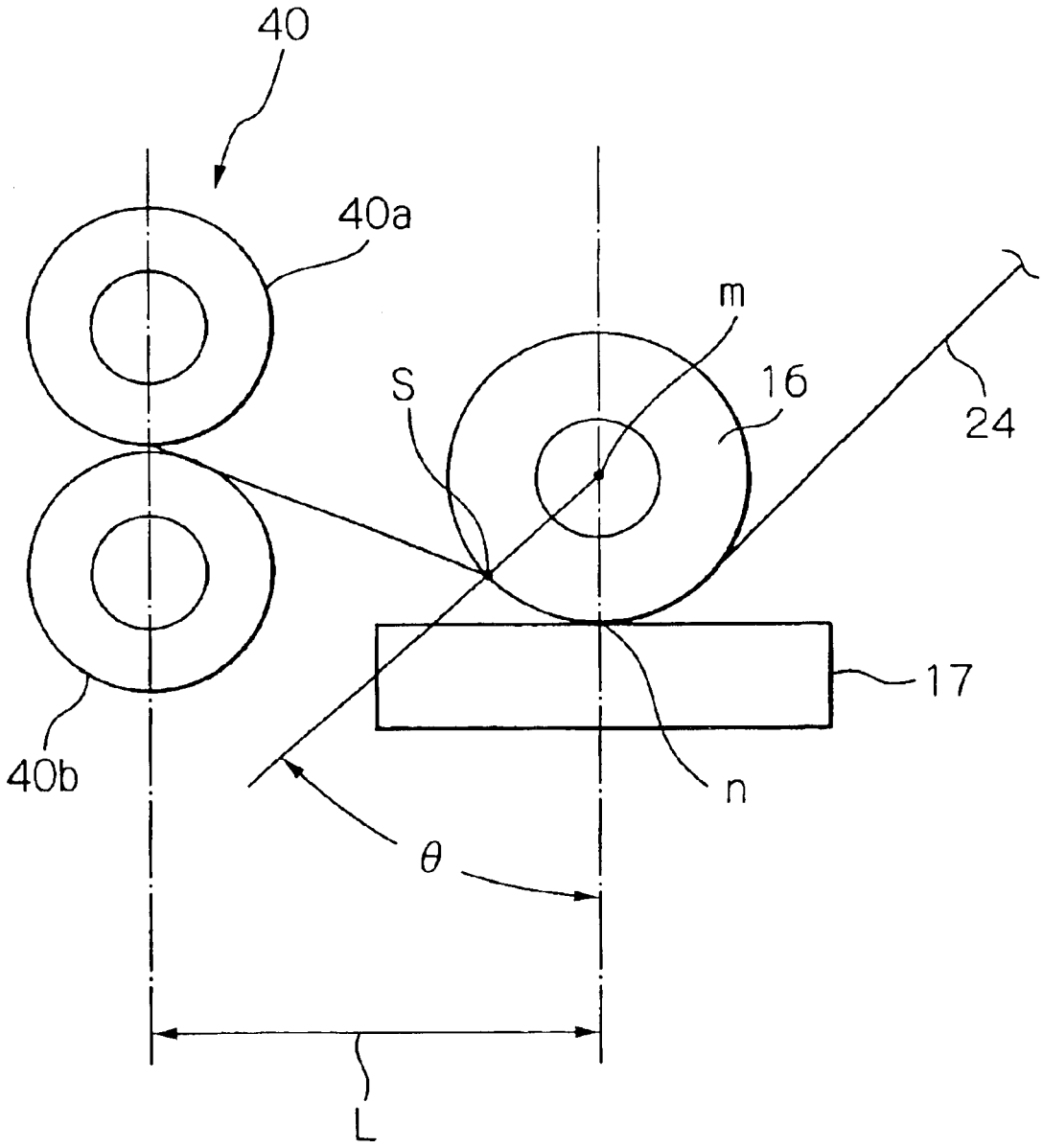
FIG. 3 shows a positional relation between the front roller pair and a platen roller included in the illustrative embodiment.

Further, as shown in FIG. 3, assume a front angle θ between a line virtually connecting a point s where the stencil 24 parts from the platen roller 16 and the axis m of the platen roller 16 and a line virtually connecting the nip center n of the platen roller 16 and thermal head 17 and the above axis m. Then, in the illustrative embodiment, the illustrative embodiment uses the front angle θ in order to prevent the influence of the nip pressure of the master 24 derived from the front tension roller pair 40 from extending to the nip pressure of the platen roller 16 and thermal head 17. More specifically, the point s is positioned as far from the nip center n as possible in order to achieve the above purpose.

It is to be noted the reduced distance between the front tension roller pair 40 and the platen roller 16 or the front angle θ suffices to obviate the shift of a master ascribable to the non-uniform tension distribution even when used alone.

While the charging of the stencil 24 has been shown and described as being reduced by the configuration of one of the front tension rollers, the same purpose is achievable even when the roller is partly formed of a material capable of reducing charging.

In summary, it will be seen that the present invention provides a low cost, simple master making device capable of surely conveying even a soft stencil by reducing the influence of static electricity, and a stencil printer using the same.

Various modifications will become possible for those skilled in the art after receiving the teachings of the present disclosure without departing from the scope thereof.

What is claimed is:

1. A stencil making device comprising:

means for making a stencil in accordance with image data; and a plurality rotary conveying members different in position from each other and configured to convey the stencil while in pressing contact with said stencil;

wherein, among said plurality of rotary conveying members, one of rotary conveying members, which are paired with each other, expected only to convey said stencil, reduces charging of said stencil.

2. The device as claimed in claim 1, wherein said one rotary conveying member has a smooth surface and contacts the stencil first before said stencil is nipped, and wherein said one rotary conveying member is configured to reduce an area of contact with said stencil.

3. The device as claimed in claim 2, wherein said one rotary conveying member is formed with a plurality of groove portions spaced from each other in an axial direction of said one rotary conveying member and each having a small diameter not contacting the stencil.

4. The device as claimed in claim 3, wherein said plurality of grooves each have a width ranging from 5 mm to 30 mm.

5. The device as claimed in claim 3, wherein said plurality of groove portions each have a depth ranging from (1 ×stencil thickness) to (10 ×stencil thickness), as measured in a direction perpendicular to the axial direction of said one rotary conveying member.

6. The device as claimed in claim 1, wherein one of said plurality of rotary conveying members comprises a platen roller pressed against said means for making, and wherein said rotary conveying members paired with each other are positioned downstream of said platen roller in a direction of stencil conveyance.

7. The device as claimed in claim 6, a line virtually connecting a point where the stencil parts from said platen roller and an axis of said platen roller and a line virtually connecting a nip center of said platen roller and said means for making and said axis of said platen roller make an angle therebetween.

8. The device as claimed in claim 6, wherein a distance between said platen roller and said rotary conveying members paired with each other lies in a range in which an influence of a nip pressure of the stencil derived from said rotary conveying members does not extend to a nip pressure of said platen roller and said means for making.

9. In a stencil printer for performing printing by wrapping a stencil perforated by a stencil making device around a print drum, said stencil making device comprising:

means for making a stencil in accordance with image data; and a plurality rotary conveying members different in position from each other and configured to convey the stencil while in pressing contact with said stencil;

wherein, among said plurality of rotary conveying members, one of rotary conveying members, which are paired with each other, expected only to convey said stencil, reduces charging of said stencil.

10. The printer as claimed in claim 9, wherein said one rotary conveying member has a smooth surface and contacts the stencil first before said stencil is nipped, and wherein said one rotary conveying member is configured to reduce an area of contact with said stencil.

11. The printer as claimed in claim 10, wherein said one rotary conveying member is formed with a plurality of groove portions spaced from each other in an axial direction of said one rotary conveying member and each having a small diameter not contacting the stencil.

12. The printer as claimed in claim 11, wherein said plurality of grooves each have a width ranging from 5 mm to 30 mm.

13. The printer as claimed in claim 11, wherein said plurality of groove portions each have a depth ranging from (1 ×stencil thickness) to (10 ×stencil thickness), as measured in a direction perpendicular to the axial direction of said one rotary conveying member.

14. The printer as claimed in claim 9, wherein one of said plurality of rotary conveying members comprises a platen roller pressed against said means for making, and wherein said rotary conveying members paired with each other are positioned downstream of said platen roller in a direction of stencil conveyance.

15. The printer as claimed in claim 14, a line virtually connecting a point where the stencil parts from said platen roller and an axis of said platen roller and a line virtually connecting a nip center of said platen roller and said means for making and said axis of said platen roller make an angle therebetween.

16. The printer as claimed in claim 14, wherein a distance between said platen roller and said rotary conveying members paired with each other lies in a range in which an influence of a nip pressure of the stencil derived from said rotary conveying members does not extend to a nip pressure of said platen roller and said means for making.

* * * * *